United States Patent [19]

Sawazaki

[11] Patent Number: 4,481,794

[45] Date of Patent: Nov. 13, 1984

[54] YARN FEEDING APPARATUS FOR CIRCULAR KNITTING MACHINES

[75] Inventor: Masatoshi Sawazaki, Hyogo, Japan

[73] Assignee: Precision Fukuhara Works, Ltd., Kobe, Japan

[21] Appl. No.: 434,364

[22] Filed: Oct. 14, 1982

[30] Foreign Application Priority Data

Feb. 5, 1982 [JP] Japan ..... 57-017233

[51] Int. Cl.[3] ..... D04B 15/48

[52] U.S. Cl. ..... 66/132 T; 66/146; 226/183

[58] Field of Search ..... 66/132 R, 132 T; 226/183; 242/47.01

[56] References Cited

U.S. PATENT DOCUMENTS

| | | | |
|---|---|---|---|
| 393,189 | 11/1888 | Stowe | 66/132 R X |
| 2,217,225 | 10/1940 | Lawson et al. | 66/132 R |
| 3,263,454 | 8/1966 | Butler | 66/132 R |
| 3,651,668 | 3/1972 | Pernick | 242/47.01 X |
| 4,058,245 | 11/1977 | Hurt et al. | 226/183 X |
| 4,355,747 | 10/1982 | Vinas | 66/132 T X |

FOREIGN PATENT DOCUMENTS

| | | | |
|---|---|---|---|
| 942347 | 11/1963 | United Kingdom | 66/132 R |
| 2093077 | 8/1982 | United Kingdom | 66/132 T |

*Primary Examiner*—Wm. Carter Reynolds
*Attorney, Agent, or Firm*—Nathan Levin

[57] ABSTRACT

Self actuating yarn feeding apparatus to feed yarn to a circular knitting machine when the machine makes a demand for the yarn and to cease feeding the yarn when the machine ceases demand for the yarn. The yarn is in variable circumferentially extending drive contact with the periphery of a frictionally surfaced rotating yarn feed wheel to feed the yarn to the machine. The arrangement being such that when there is a lack of demand for the yarn the degree of contact between wheel and yarn is not sufficient to feed the yarn and when there is demand for the yarn the degree of contact between wheel and yarn is sufficient to feed the yarn to the machine. The yarn extending through a yarn eyelet movable back and forth along a circular pathway in response to demand and lack of demand for the yarn by the machine to vary the degree of contact between wheel and yarn.

5 Claims, 9 Drawing Figures

YARN FEEDING APPARATUS FOR CIRCULAR KNITTING MACHINES

Figure 2:
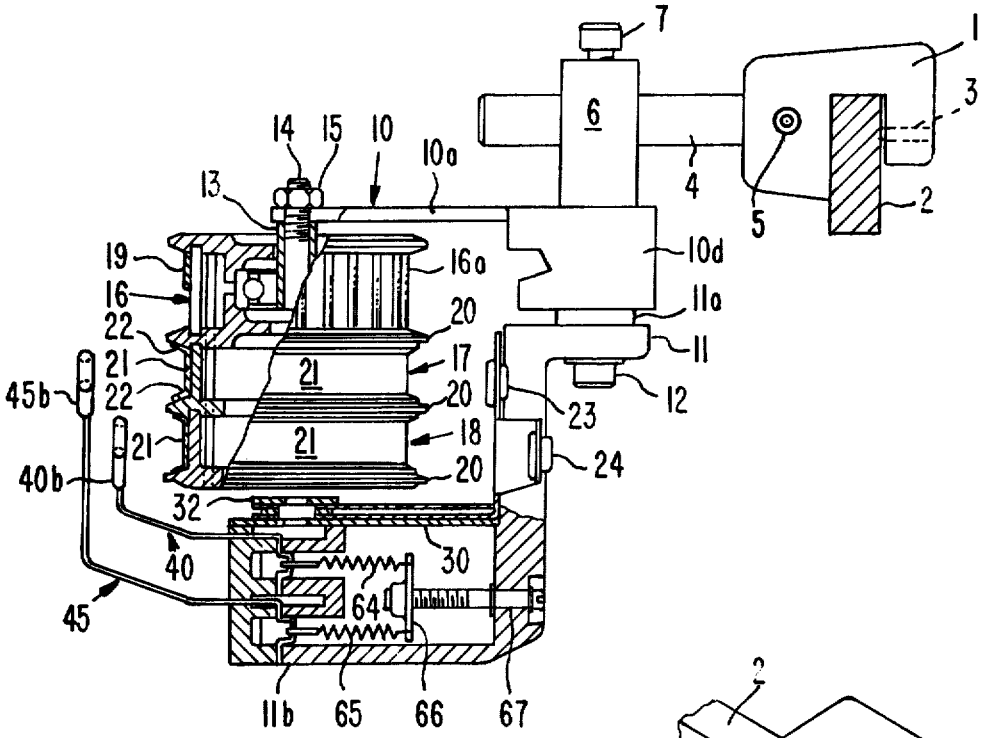

The present invention relates generally to the art of knitting and more particularly to an improvement in self actuated positive yarn feeding means as used with circular knitting machines for the positive feeding of yarns to the machines in response to and for the time that a demand or call for yarn is made by the knitting action of the needles of the machine.

Knitted fabric, of plain or stripe or of pattern formation, is generally of superior quality when the yarns making the same are fed in a positive manner at a desired rate of feed to the machine making the fabric.

All of the needles knit the yarns when making plain fabric on multi-feed machines with the result that a continuous demand for yarn is created at each feed of the machine. Positive feeding of the yarns to supply this demand at a desired rate of feed may be made by the apparatus shown in the Rosen U.S. Pat. Nos. 3,090,215 and 3,243,091 wherein an endless tape driven at an adjustable speed is trained over and rotates each of a circularly spaced series of vertically extending feed wheels or rollers and wherein yarns placed between the tape and the periphery of the feed wheels are positively fed to the machine.

The same continuous demand for yarn continues when making striped fabric, however, the newly active yarn to form the stripe is now to be positively fed while the feeding of the idled yarn is discontinued. Apparatus to positively feed the newly active yarn and at the same time to discontinue the feeding of the idled yarn is shown in the Nance U.S. Pat. No. 3,418,831 wherein pattern controlled means moves the yarn axially of the feed wheels into and out of driven contact with the driving tape.

The feeding and non-feeding of a yarn as determined by its driven and non-driven axially spaced positions on its feeding wheel relative to the driving tape can also be accomplished by a self actuating yarn feeding device having individual self acting yarn brackets, U.S. Pat. No. 3,950,966, wherein the tension created in a selected yarn by the demand for the same acts to rock its bracket in one direction to shift the yarn into driven position between the tape and the wheel to be fed thereby. When demand for the selected yarn ceases, the resulting lack of tension therein causes its bracket to rock in the opposite direction to shift the yarn into non-driven position away from the tape wherein it ceases to be fed thereby.

A self actuating yarn feeding device shown in U.S. Patent Application Ser. No. 102,453, filed Dec. 11, 1979, is provided with a feed wheel for each yarn and with a driving tape to rotate the feed wheels, however, the yarn is not fed between the wheels and the tape, as in the above cited patents, instead the yarn is fed only by the feed wheels with the tape being used only to rotate the wheels. The periphery of each wheel is divided into an upper high friction yarn feeding zone and a lower low friction non-yarn feeding zone. The yarn is guided by and is fed through fixed yarn eyelets in such manner that tension created in a selected yarn by demand for the same causes it to shift itself axially of the wheel from the low friction to the high friction zone of the wheel to be fed thereby and, when demand for the yarn ceases, the resulting lack of tension therein causes the yarn to shift itself axially of the wheel from the high friction to the low friction zone wherein it ceases to be fed by the wheel.

The present application is for an improvement over my application Ser. No. 303,633, filed Sept. 18, 1981. In the latter application the periphery of each feed wheel is divided into a lower high friction yarn feeding zone and an upper low friction non-feeding or idling zone. Individual self acting yarn brackets are used to shift the yarn between the zones, the brackets rocking in response to tension and to lack of tension in the yarn as results from demand and lack of demand for the yarn.

It is the principal object of the present invention to provide an improvement in self actuated positive yarn feeding apparatus for the positive feeding of yarns to circular knitting machines in response to and for the time that a demand for the yarns is made by the knitting action of the needles of the machines, and wherein the apparatus is more sensitive to and responds quicker to changes in demand for yarn by the needles of the machine. The present apparatus also responds to intermittent demands for the same yarn during the knitting of pattern fabric wherein it is only the needles knitting the pattern yarn which creates the demand for yarn.

It is an object of the present invention to provide a driven yarn feed wheel having an all over friction surface to feed the yarn in contact therewith when there is a demand for the same and not to feed the yarn when the demand ceases, wherein circumferential contact between the friction surface of the wheel and the yarn is maintained at all times, with the demand and lack of demand for the yarn automatically determining the angular contact between wheel and yarn with consequent feeding or non-feeding of the yarn by the wheel taking place as a result thereof.

With the above and other objects in view as will become apparent from the accompanying drawings and the description thereof, the invention resides in the improvement in the yarn feeding apparatus for circular knitting machines as shown and as described, and as set forth in the appended claims.

Figure 1:
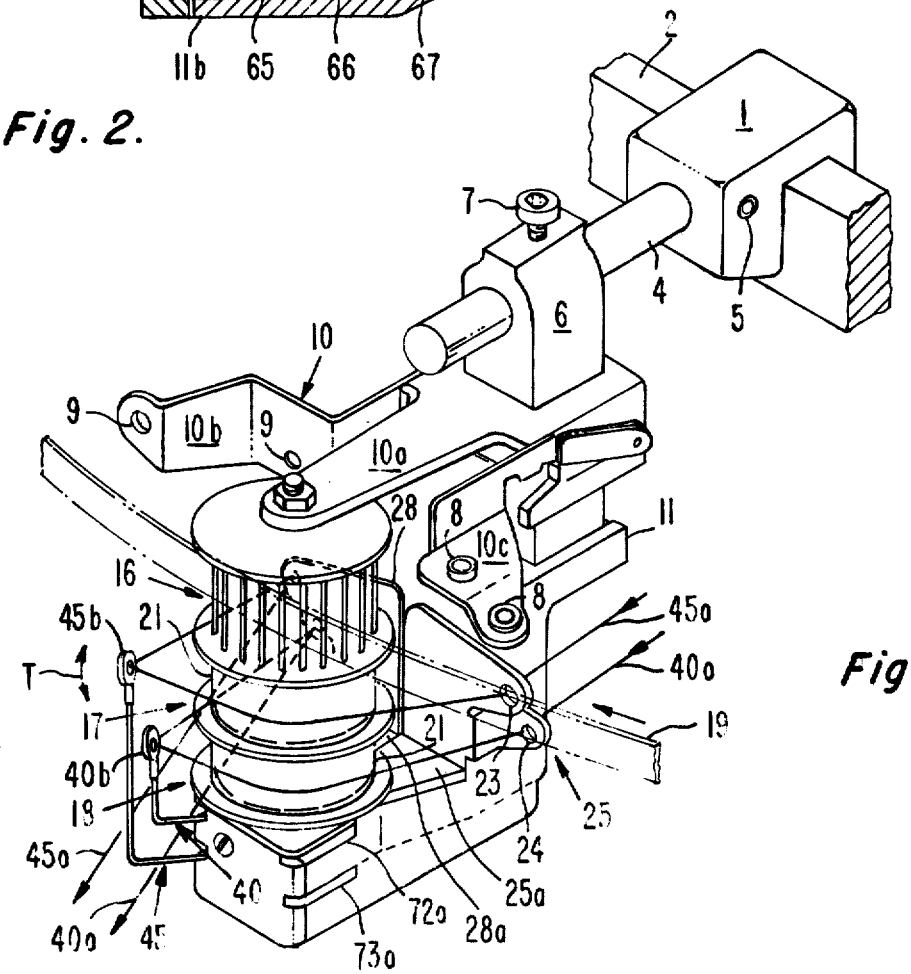
Figure 3:
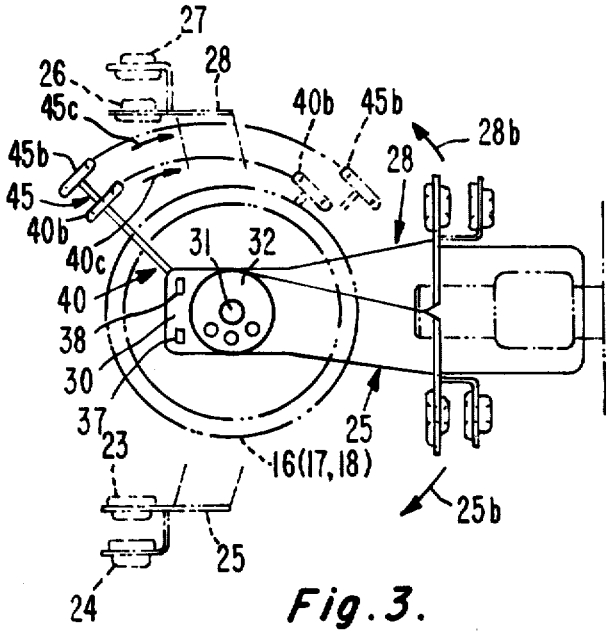
Figure 4:
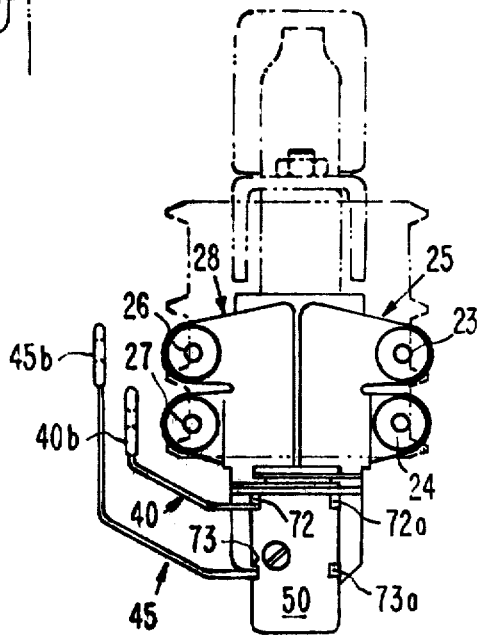
Figure 5:
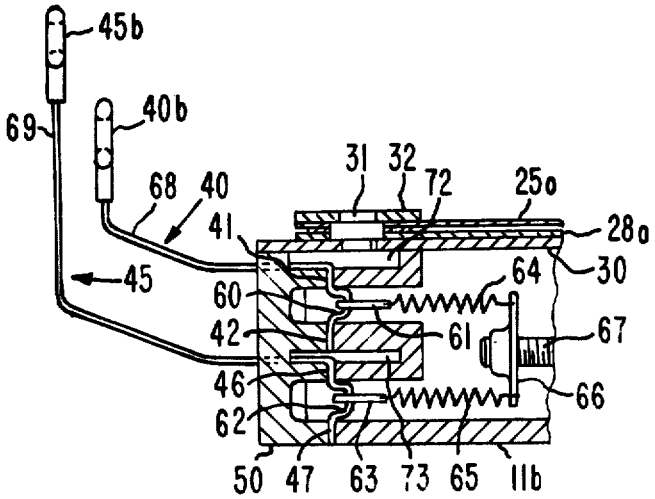
Figure 7:
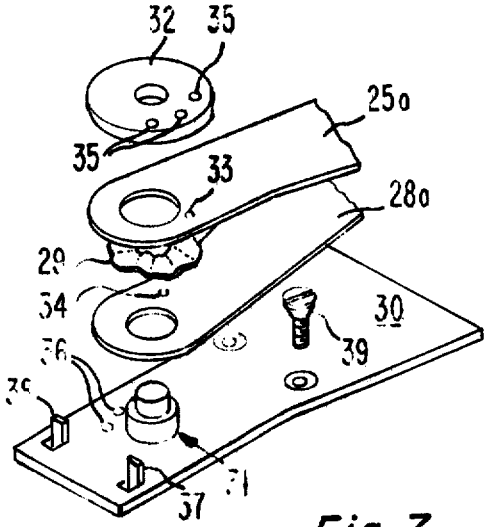
Figure 6:
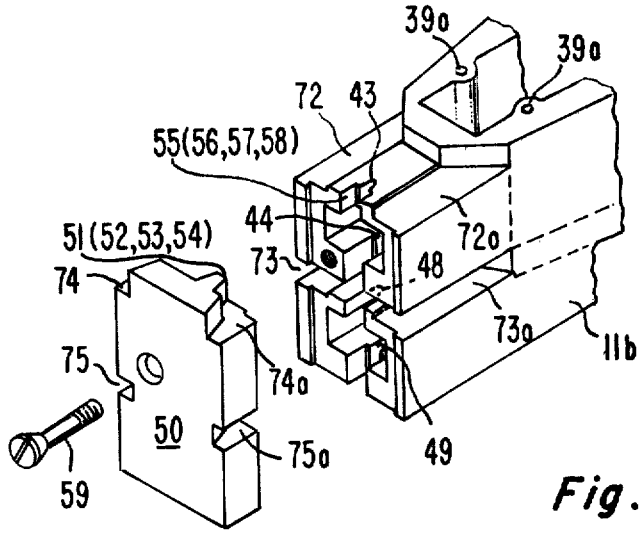
Figure 8:
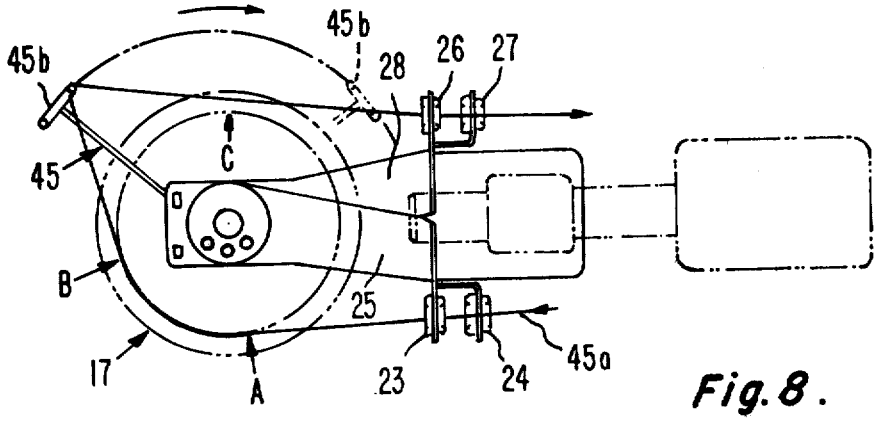
Figure 9:
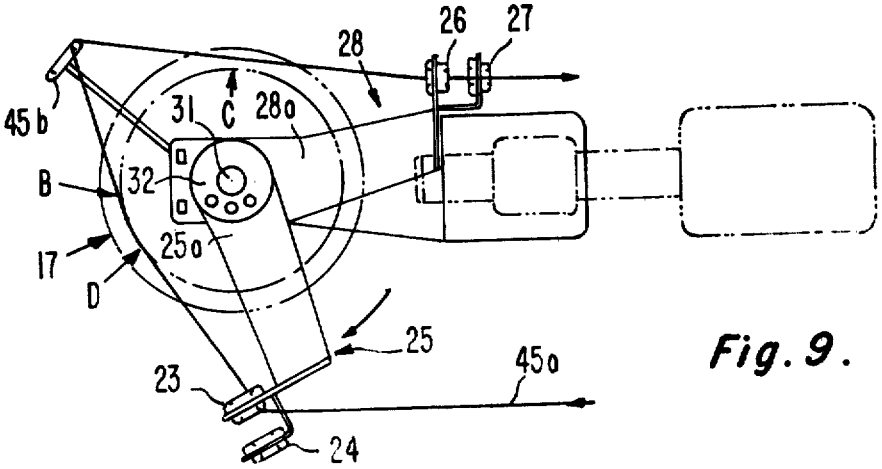

In the drawings:

FIG. 1 is a perspective view of the self actuating positive yarn feeding apparatus of the present invention showing a pair of yarn feeding wheels, a yarn in driven engagement with each wheel, a circumferentially moving yarn eyelet for each yarn to guide the same about its related wheel, and the body of the apparatus containing controls for the yarn eyelets, FIG. 2 is a side elevational view, partly in section, of the apparatus shown in FIG. 1, FIG. 3 is a plan view, partly in dotted line, of FIG. 2, FIG. 4 is a front end view of FIG. 3, FIG. 5 is an enlarged view, in section, of a portion of FIG. 2, showing the interior of the body of the apparatus, FIG. 6 is an exploded view in perspective of a portion of the body, FIG. 7 is an exploded view in perspective of the cover plate of the body, FIG. 8 is a plan view similar to FIG. 3 showing the mode of operation of the apparatus, and FIG. 9 is a plan view similar to FIG. 8 showing an adjusted position of the apparatus.

While the improved yarn feeding apparatus of the present invention can be mounted upon a knitting machine in more than one way, it is shown in the drawings as being mounted upon a prior art type of yarn feeding device (which device is itself mounted upon the knitting machine) wherein an endless driven yarn feeding tape is trained over and drives each of a plurality of circularly spaced yarn feeding wheels and wherein yarns positioned between the tape and the wheels are driven thereby to be fed to the knitting machine. Such mounting of the present yarn feeding apparatus has the advantage that not only can it and the prior art yarn feeding device be used either together or independantly of each other, but in addition thereto the tape and wheels of the prior art device can also be used to drive the wheels of the present yarn feeding apparatus. However, it will be understood that the yarn feeding wheels of the present apparatus can be driven by other means.

The knitting machine has a holder 1 secured to a support ring 2 by a screw 3, FIGS. 1, 2, while a radially extending support arm 4 is secured in the holder by a screw 5. A radially movable block 6 is adjustably secured to the support arm by a screw 7. A prior art tape and wheel yarn feeding device, indicated generally at 10, is secured to the underside of block 6 by a screw 12 extending upwardly through a suitable aperture in the top of an inverted L-shaped frame member 11, through a spacer 11*a*, through the base 10*d* of device 10, and into threaded engagement with block 6. Device 10 is provided with a centrally extending arm 10*a* and with laterally extending side arms 10*b*, 10*c* having spaced pairs of yarn eyelets 9, 9 and 8, 8, respectively, formed therein. A rotatably journalled yarn feed wheel 16 of the prior art device turning about a vertical axis is mounted upon arm 10*a* by a screw 14 extending through a hollow shaft 13 of the wheel and through the arm to which it is secured by a nut 15. A driving tape 19 is trained about the upper periphery of wheel 16 to rotate the same in the direction of the arrow in FIG. 1. The periphery of wheel 16 is provided with a circular series of spaced vertically extending pins 16*a* which offer little or no frictional resistance to a yarn passing thereover. When yarn is threaded through appropriate eyelets 8, 9 and is positioned between and in contact with the periphery of wheel 16 driven thereby, the yarn is driven and is fed to the needles of the knitting machine. Arms 10*b*, 10*c* are rockable and yarn feeding may be discontinued by lowering the arms to accordingly lower the yarn to a position on the wheel below the moving tape. Eyelets 9, 9 and 8, 8 are placed so that one or a pair of yarns can be fed by the device 10 to the machine.

The apparatus of the present invention includes a pair of yarn feed wheels 17, 18 axially aligned with and secured to the underside of wheel 16 to rotate therewith, the wheels being provided with spaced flanges 20. The periphery of the wheels is covered with suitable anti-static material 21 having a relatively high frictional surface, such as an elastic band or the like, with the material extending upwardly onto the flanges as at 22. The covered flanges are effective in keeping twist yarns from slipping off the frictional surface of the wheel as could be the case in the absence of the covered flanges.

A first pair of eyelets 23, 24, vertically spaced at one side of the wheels, is provided in a first L-shaped wing member 25, and a second pair of similar eyelets 26, 27 is provided at the other side of the wheels in a second similar L-shaped wing member 28. A pair of vertically spaced eyelets 40*b*, 45*b* are provided at the front of the wheels at the upper ends of a pair of vertically extending circumferentially movable L-shaped substantially rigid yarn guide arms 40, 45, eyelet 45*b* being at the level of eyelets 23, 26 while eyelet 40*b* is at the level of eylets 24, 27. A yarn 45*a* threaded through eyelet 23, passes about wheel 17 in driven contact therewith, passes through eyelet 45*b*, and exits through eyelet 26 on its way to the machine. A yarn 40*a* enters through eyelet 24, passes about wheel 18 in driven contact therewith, passes through eyelet 40*b* and exits through eyelet 27 on its way to the machine.

The wing members 25, 28 are L-shaped with horizontal arms 25*a*, 28*a* which encircle and pivot about a pin 31 extending upwardly from cover plate 30 of the box-like portion 11*b* of the frame member 11. The cover is secured to the box 11*b* by one or more screws 39 extending through the cover and into threaded engagement with the box. The wing members are adapted to pivot between their full and dotted line positions of FIG. 3, the latter position making it easy for an operator to thread the wing members. A resilient spring washer 29 encircles pin 31 between arms 25*a*, 28*a*, all of which are retained on the pin by a cover plate 32 secured to the pin. There is a dimple or rounded pin head 33 formed in and extending upwardly from arm 25*a* beneath cover plate 32, and a similar dimple 34 extending downwardly from arm 28*a* and above cover 30. There are three circumferentially spaced apertures 35 formed in plate 32 into each of which dimple 33 is adapted to be yieldingly retained as arm 25*a* and wing 25 are turned about pin 31. Similarly, there are three spaced apertures 36 formed in cover 30 into each of which dimple 34 is adapted to be yieldingly retained as arm 28*a* and wing 28 are turned about pin 31. Cover plate 30 is provided with spaced upstanding lugs 37, 38 as limit stops for arms 25*a*, 28*a* in dotted line position of FIG. 3. Each of wing members 25, 28 may also be placed in intermediate positions between their positions of FIG. 3, as shown by the intermediate position of wing member 25 in FIG. 9.

In FIGS. 5, 6, L-shaped yarn guide arm 40 has a yarn eye 40*b* at end 68 thereof opposite lower wheel 18 while its lower end has a bell crank arm 60 between bearing arms 41, 42 which turn in bearings 43, 44. Similarly, L-shaped yarn guide arm 45 has a yarn eye 45*b* at end 69 thereof opposite upper wheel 17 while its lower end has a bell crank arm 62 between bearing arms 46, 47 which turn in bearings 48, 49. Arms 40,45 turn about vertically extending co-axial bearings 41, 42 and 46, 47 which are parallel to the vertical axis of wheels 17, 18. Front cover plate 50, secured to box 11*b* by a screw 59 extending through the plate into threaded engagement with the box, has convex shaped portion 51, 52, 53, 54 which fit into concave shaped portions 55, 56, 57, 58 provide in front of bearings 43, 44, 48, 49 to hold the bearing arms 41, 42, 46 and 47 in place. Connecting rods 61, 63 are interposed between and suitably connected to crank arms 60 and 62 and to one end of tension springs 64, 65, respectively. The other ends of the springs are secured to a sliding plate 66 in threaded relation to screw 67 extending freely through the rear wall of box 11*b*. The spring tensions can be sutitably adjusted by turning the screw 67. The circumferential movement of guides 40, 45 is limited by cut out stops 72, 73 in box 11*b* and 74, 75 in cover 50. A similar but oppositely disposed set of cut outs 72*a*, 73*a* and 74*a*, 75*a* are provided for use as limit stops when it is desirable to have the guides 40, 45 disposed in a circumferentially spaced 'left hand' position.

A description of the device in relation to yarn 45*a* will suffice for both of the yarns. When no demand is made for yarn 45*a*, with both wing members 25, 28 in retracted position of FIG. 8, the yarn is in contact with rotating wheel 17 along initial arc A, B thereof and eyelet 45b is in its full line position (being held there against a stop by tensioned spring 65) in which it holds the yarn away from the periphery of the wheel except along arc A, B. Such contact between wheel and yarn along arc A, B would tend to feed the yarn, however, such tendency is overcome by suitable upstream tension on the yarn so that it slips on the wheel and is not fed. Then, when a demand is made for yarn 45a, tension in the yarn not only overcomes the upstream tension thereon but also overcomes the pre-set tension in spring 65 so that arm 45 and eyelet 45b is turned in the direction of the arrow (which is also the direction of travel of the yarn) to its dotted line position whereby contact between wheel and yarn is increased to arc A, B, C, with the result that the yarn is fed by the wheel to the needles. If it be desirable to have less initial arcuate contact between wheel and yarn, wing member 25 can be turned about pin 31 from its position of FIG. 8 to its position of FIG. 9 in the direction of the arrow and yieldingly held in such position by the dimple 33 in an appropriate one of the apertures 35. Initial contact between yarn and wheel, FIG. 9, is then along arc D, B when there is no demand for yarn and is along arc D, B, C when there is a demand for yarn. The tension in springs 64, 65 may be adjusted to return arms 40, 45 to their full line position of FIG. 3 when there is no demand for the yarn and so that such tension is immediately overcome when there is yarn demand. It will be noted that when one or both of the wing members 25, 28 are moved to their dotted line positions for ease in threading, FIG. 3, the eyelets 23, 24 and 26, 27 are moved to a position in which they face each other.

It will also be noted that due to the existing contact between the rotating wheel and the yarn when there is no demand for nor feeding of the yarn, not only is there instant yarn feeding by the wheel when there is a yarn demand, but also there is a lack of yarn breakage as is the case in other prior art types of feed devices wherein the yarn is shifted from non-frictional to frictional driving surfaces.

While the present apparatus may be used for the feeding and non-feeding of yarns used in the knitting of striped and of other patterned fabrics, it also serves as an automatic compensator for variations in yarn tensions at the cones thereof.

Prior art U.S. Pat. Nos. 2,441,118 and 2,539,527 are referred to as showing the type of yarn feeding apparatus of the present invention. In the present apparatus the yarn eyelets 40b, 45b reciprocate along the pathways of circles the centers of which are located within a cylindrical figure defined by the circumference of the yarn feed wheels 17, 18, the circle centers being in the vertically extending bearing axis 41, 42 of eyelet 40b and 46, 47 of eyelet 45b. The eyelets, their arms 40, 45 and springs 64, 65 are thus compactly arranged out of the way directly below the feed wheels.

I claim:

1. Self-actuating yarn feeding apparatus for feeding yarn to a circular knitting machine when the machine makes a demand for the yarn and to cease feeding the yarn when the machine ceases to make such a demand, the apparatus comprising a yarn feed wheel rotatable about a vertical axis, rotation means to rotate the yarn feed wheel, a pair of spaced yarn guide eyelets to direct the yarn circumferentially about the rotating wheel, the yarn being in contact with the peripheral surface of the wheel at all times, control means acting upon the yarn to vary the degree of circumferential contact between the yarn and the peripheral surface of the rotating wheel, the arrangement providing that when the machine ceases to make a demand for the yarn the degree of contact between the yarn and the rotary wheel is insufficient to cause the wheel to feed the yarn to the machine and that when the machine makes a demand for the yarn the degree of contact between the yarn and the rotary wheel is sufficient to cause the wheel to feed the yarn to the machine, the control means providing an additional yarn eyelet through which the yarn passes as it moves between and through the pair of eyelets, the additional yarn eyelet being movable back and forth in a circular path about a vertical axis which is parallel to the axis of the yarn feed wheel and which is located within a cylinder defined by the peripheral surface of the wheel with the additional eyelet itself being located without the so defined cylinder, the additional eyelet being mounted upon a substantially rigid guide arm extending between itself and its axis of rotation, and being so movable in response to demand and lack of demand for the yarn by the machine thereby to automatically provide the appropriate degrees of contact between the yarn and the rotating wheel to feed and not to feed the yarn to the machine.

2. Apparatus as in claim 1 for individually feeding the said yarn and a second yarn to a circular knitting machine, wherein the apparatus has a second pair of spaced yarn guide eyelets and a second additional yarn guide eyelet for the second yarn, the second additional yarn eyelet being independently movable back and forth in a circular path about a common vertical axis which is parallel to the axis of the yarn feed wheel and which is located within the cylinder defined by the peripheral surface of the yarn feed wheel with the second additional yarn eyelet being located without the so defined cylinder.

3. Apparatus as in claim 2 wherein the radius of one of the circular paths is shorter than the radius of the other circular path.

4. Apparatus as in claim 3 wherein the level of the additional yarn eyelet in the circular path having the shorter radius is at a level below the level of the other additional yarn eyelet.

5. Apparatus as in claim 1 wherein at least one of the spaced pair of yarn guide eyelets is manually adjustable angularly with respect to the feed wheel to vary the degree of circumferential contact between the yarn and the peripheral surface of the yarn feed wheel.

* * * * *